United States Patent [19]

Ayano et al.

[11] 4,153,479

[45] May 8, 1979

[54] ACIDIC ZINC PHOSPHATE SOLUTION AND METHOD

[75] Inventors: Yukihiko Ayano, Hachioji; Kuniji Yashiro, Ayasemachi; Akira Niizuma, Ichidawa, all of Japan

[73] Assignee: Oxy Metal Industries Corporation, Detroit, Mich.

[21] Appl. No.: 838,330

[22] Filed: Sep. 30, 1977

[30] Foreign Application Priority Data

Oct. 1, 1976 [JP] Japan ..... 51-117123

[51] Int. Cl.[2] ..... C23F 7/08

[52] U.S. Cl. ..... 148/6.15 Z

[58] Field of Search ..... 148/6.15 Z, 6.17

[56] References Cited

U.S. PATENT DOCUMENTS

| | | | |
|---|---|---|---|
| 2,516,139 | 7/1950 | Mazia | 148/6.15 R |
| 3,307,979 | 3/1967 | Upham | 148/6.15 Z |

FOREIGN PATENT DOCUMENTS

| | | | |
|---|---|---|---|
| 223793 | 9/1959 | Australia | 148/6.15 Z |
| 866377 | 4/1961 | United Kingdom | 148/6.15 Z |

*Primary Examiner*—Ralph S. Kendall

[57] ABSTRACT

An aqueous acidic oxidant-free zinc phosphate solution contains tartaric acid, citric acid and/or a salt of either. At a pH of about 3.5 to 4.7, the solution produces a microcrystalline coating of zinc phosphate on iron or steel. The solution preferably contains nickel ion also.

7 Claims, No Drawings

ACIDIC ZINC PHOSPHATE SOLUTION AND METHOD

BACKGROUND OF THE INVENTION

This invention relates to a composition and method for forming a zinc phosphate coating on a metal surface, particularly on iron and steel. The present invention is intended to provide a zinc phosphate coating solution which eliminates the use of any oxidant used conventionally for promoting the chemical conversion such as nitrate ion, nitrite ion, chlorate ion, bromate ion and the like. Absence of such oxidants serves to reduce the amount of sludge formed during the chemical conversion coating by reducing metallic ions dissolved from the base metal surface treated while imparting excellent corrosion resistance and other qualities.

Zinc phosphate coating has conventionally been applied on surfaces of iron and steel as a base coating for subsequent painting to improve the durability of the top coated paints. However, conventional zinc phosphate coating solutions contain, in general, an oxidant such as nitrate ion, nitrite ion, chlorate ion, bromate ion and the like as a promoter or accelerator. Such oxidants are decomposed during the chemical conversion coating generating undesirable by-product gases. Metals dissolved from the surface of the base metal during the chemical conversion coating contribute to sludge formation. The presence of an oxidant accelerates the rate of dissolution and also the rate of sludge formation. In addition, such oxidants are conventionally added in the form of alkali metal salts such as Na or K so that upon decomposition during the course of chemical conversion coating alkali metal ions accumulate in the bath. As a result, dihydrogen zinc phosphate is hydrolyzed to form sludge so that the rate of sludge formation tends to be increased even more. Such sludge must be removed and discarded periodically resulting in excessive labor and expense.

It has been disclosed in British Pat. No. 866,377, Japanese Patent Publication No. 26455/1967, 10925/1971 and 2648/1973 to add citric acid or tartaric acid to a zinc phosphate coating solution containing an oxidant. Such chemical conversion solutions contain an oxidant and free phosphoric acid and are controlled in such a manner that only when the contents of the phosphates and free phosphoric acid are maintained in a certain range, will a zinc phosphate coating be formed on the metal surface by adjusting the pH to a value of less than 3.5. Due to the inclusion of an oxidant, sludge is formed in an excessive amount. Disclosed in Prepublished Japanese Patent Application No. 5839/1974 is a treating solution containing predominantly an alkali metal phosphate and a metallic ion such as zinc in a minor amount ranging from 20 ppm to the solubility limit exhibiting a pH from 3.8 to 6.0. However, due to the fact that zinc phosphate has a lower solubility, the amount of dissolved zinc ion which can be maintained is low. (G. Chalot: Qualitative Analysis II translated in Kyoritsu Zensho, pp 432.) In addition, as the solubility decreases linearly with increased pH, such solution gives a substantially iron phosphate coating.

SUMMARY OF THE INVENTION

It has now been found that the rate of sludge formation can be reduced without sacrificing quality of the zinc phosphate coating by including at least one member selected from the group consisting of tartaric acid, citric acid and soluble salts thereof in an aqueous solution containing from 0.01 to 0.2% by weight of zinc ion, from 0.3 to 5% by weight of phosphate ion and free from any oxidant in a weight ratio of Zn:Tartaric or Citric Acid equivalent of from 0.1 to 20 and adjusting to a pH value of from about 3.5 to 4.7 In a preferred embodiment, it is desirable to further include from 0.01 to 0.2% by weight of nickel ion in the solution.

DETAILED DESCRIPTION OF THE INVENTION

Phosphate ion should be present in the solution according to the present invention in an amount sufficient for forming primary phosphates of zinc or zinc and nickel. Thus, the phosphate ion should be present in an amount of higher than 0.3% by weight, generally from 0.3 to 5% by weight. The zinc ion should be present in an amount of higher than 0.01% by weight, generally from 0.01 to 0.2% by weight. At least one member selected from citric acid, tartaric acid and their soluble salts should be present in a ratio by weight of from 0.1 to 20 (calculated as citric or tartaric acid) with respect to the zinc ion to prevent any precipitation from the solution and to maintain solution stability. For example, the ratio is preferably maintained within the range of from 0.3 to 0.8 at a pH from 3.5 to 3.7 and from 4 to 16 at a pH from 4.4 to 4.6.

The components of the composition may be supplied in the form of any soluble compound. Alkali metal containing compounds are preferably minimized. Preferably, the phosphating solution is prepared by using phosphoric acid, a zinc compound such as zinc oxide, zinc carbonate, zinc hydroxide, at least one compound selected from the group comprising tartaric acid, sodium tartarate, citric acid, sodium citrate and other soluble compounds derived from citric or tartaric acid and if desired a nickel compound such as nickel carbonate and the like and then adjusting the pH of the resulting solution with an alkali such as sodium carbonate, potassium carbonate, sodium hydroxide, potassium hydroxide or the like.

When one attempts to maintain an aqueous solution of zinc phosphate free from tartaric or citric acid within the pH range according to the present invention at a chemical conversion temperature ranging from 50 to 60 degrees C, zinc phosphate will be precipitated from the solution until a stable equilibrium is maintained at a pH of lower than 3.5. In addition, when such solution is repeatedly adjusted to a pH of higher than 3.5 by adding, for example, sodium hydroxide or the like, the amount of zinc ion will be reduced to an extent unsuitable for obtaining a zinc phosphate coating. Tartaric acid and citric acid maintain the dissolved zinc ion at the desired concentration.

The phosphating solution according to the present invention is used within the pH range from about 3.5 to 4.7 for best quality. In a solution containing zinc ion in an amount of higher than 0.2% by weight and less than a 0.1 weight ratio of citric acid and/or tartaric acid, ferrous ion will accumulate in the solution, resulting in difficult formation of a uniform and stable zinc phosphate coating. In general, when ferrous ion is accumulated in an amount of higher than 0.5 g/l in the solution, yellow stains and other defects will develop on the treated metal surface.

When employed, the desired nickel ion concentration ranges desirably from 0.01 to 0.2% by weight. Within such range, the chemical conversion can be achieved more effectively but beyond such range, the benefits decrease.

The formation of chemical conversion coating with high corrosion resistance and other properties as a substrate for painting can be obtained by controlling the temperature condition within a relatively wide range. Metal surfaces are chemically converted by spraying, immersing or flooding the phosphating solution. Satisfactory results are obtained by spraying the solution at a preferred temperature of from about 50 degrees C to 60 degrees C for 0.5 to 5 minutes. As the present invention uses a chemical conversion solution containing no oxidant compared to conventional chemical conversion solutions, toxic gases such as nitrogen oxides and the like are not generated. The amount of sludge formed during the course of chemical conversion can be reduced by reducing metallic ions dissolved from the metal substrate and an excellent undercoating with excellent corrosion resistance can be obtained.

The following examples illustrate the present invention.

EXAMPLE 1

A zinc phosphate coating solution was prepared to contain:

| Component | % by Weight |
|---|---|
| Phosphate ion | 0.95 |
| Zinc ion | 0.12 |
| Tartaric acid | 0.08 |

The pH of the solution was then adjusted to 3.5 by adding sodium carbonate. A cold rolled steel sheet having a size of 7 x 15 cm was sprayed with a weakly alkaline degreasing agent and then with the above-mentioned phosphating solution at 55 degrees C for 2 minutes to provide a zinc phosphate coating. The treated sheet was washed with cold water and then dried by means of hot air. The resulting coating had a microcrystalline structure and appearance satisfactory as an undercoating for painting. The amount of metal dissolved from the base metal during treatment amounted to 0.7 $g/m^2$, and the coating weight was 1.6 $g/m^2$.

EXAMPLE 2

The chemical conversion was carried out on a steel sheet cleaned in the same manner as in Example 1 with the following zinc phosphate coating solution and under the following conditions:

| Component | % by Weight |
|---|---|
| Phosphate ion | 0.95 |
| Zinc ion | 0.033 |
| Tartaric acid | 0.2 |
| Phosphating conditions: | |
| pH | 4.5 |
| Temperature and spraying time: | 55 degrees C; 2 minutes |

The resulting coating had uniform microcrystalline structure. The amount of metal dissolved from the base metal was 0.4 $g/m^2$, and the coating weight was 1.2 $g/m^2$.

EXAMPLE 3

The phosphating was carried out on a steel sheet cleaned in the same manner as in Example 1 with the following zinc phosphate coating solution and under the following conditions:

| Component | % by Weight |
|---|---|
| Phosphate ion | 0.95 |
| Zinc ion | 0.033 |
| Citric acid | 0.03 |
| Phosphating condition: | |
| pH | 3.5 |
| Temperature and spraying time: | 55 degrees C; 2 minutes |

The resulting coating had uniform microcrystalline structure. The amount of base metal dissolved was 0.5 $g/m^2$, and the coating weight was 1.4 $g/m^2$.

EXAMPLE 4

The phosphating was carried out on a steel sheet cleaned in the same manner as in Example 1 with the following zinc phosphate coating solution and under the following conditions:

| Component | % by Weight |
|---|---|
| Phosphate ion | 0.95 |
| Zinc ion | 0.08 |
| Tartaric acid | 0.08 |
| Nickel ion | 0.04 |
| Phosphating condition: | |
| pH | 3.6 |
| Temperature and spraying time | 55 degrees; 2 minutes |

The resulting coating had very uniform microcrystalline structure. The amount of base metal dissolved was 0.8 $g/m^2$ and the coating weight was 1.5 $g/m^2$.

EXAMPLE 5

The phosphating was carried out on a steel sheet cleaned in the same manner as in Example 1 with the following zinc phosphate coating solution and under the following conditions:

| Component | % by Weight |
|---|---|
| Phosphate ion | 0.95 |
| Zinc ion | 0.042 |
| Tartaric acid | 0.04 |
| Citric acid | 0.04 |
| Nickel ion | 0.126 |
| Phosphating conditions: | |
| pH | 4.0 |
| Temperature and spraying time | 55 degrees C; 2 minutes |

The resulting coating had slightly darkened uniform microcrystalline structure. The amount of base metal dissolved was 0.7 $g/m^2$ and the coating weight was 1.0 $g/m^2$.

EXAMPLE 6

The phosphating was carried out on a steel sheet cleaned in the same manner as in Example 1 with the following zinc phosphate coating solution and under the following conditions:

| Component | % by Weight |
|---|---|
| Phosphate ion | 1.14 |
| Zinc ion | 0.16 |
| Tartaric acid | 0.13 |
| Nickel ion | 0.01 |
| Phosphating condition: | |
| pH | 3.6 |

-continued

| Component | % by Weight |
|---|---|
| Temperature and spraying time | 55 degrees; 2 minutes |

The resulting coating had markedly uniform microcrystalline structure. The amount of base metal dissolved was 0.6 g/m$^2$ and the coating weight was 2.2 g/m$^2$.

COMPARATIVE EXAMPLE 1

A phosphating solution was prepared as in Example 1 except tartaric acid was omitted resulting in a precipitate of zinc phosphate at a pH of 3.5. A steel sheet was treated with that phosphating solution in the manner of Example 1. A blue iron phosphate coating rather than a zinc phosphate coating was formed.

COMPARATIVE EXAMPLE 2

A steel sheet was treated with a conventional phosphating solution having the following composition under conventional phosphating conditions:

| Component | % by Weight |
|---|---|
| Phosphate ion | 1.24 |
| Zinc ion | 0.14 |
| Nickel | 0.04 |
| Nitric acid | 0.15 |
| Chloric acid | 0.15 |
| Nitrous acid | 0.008 |
| Phosphating Conditions: | |
| pH | 3.0 |
| Temperature and spraying time | 55 degrees C; 2 minutes |

The phosphated steel sheets of Example 4 and Comparative Example 2 were electrophoretically painted (paint available from Shinto Toryo Co. under the name of Esbia NZ 5000 B 13) at 30 degrees C under 250 V for 3 minutes to a thickness of 25 microns and then baked at 170 degrees C for 30 minutes.

Table 1 shows the amounts of base metal dissolved during the phosphating, coating weight, results obtained by the salt spray test according to JIS-Z-2371 and amounts of sludge formed in the baths.

Table 1

| Example No. | Amount of dissolved metal | Weight of Coating | Salt Spray Test (240 Hrs.) -mm creepage | Amount of Sludge Formed |
|---|---|---|---|---|
| 1 | 0.8 g/m$^2$ | 1.5 g/m$^2$ | 0.5 mm | 1.8 g/m$^2$ |
| Comparative Example 2 | 1.9 | 1.9 | 0.5 | 4.1 |

What is claimed is:

1. An aqueous composition free of nitrate ion, nitrite ion, chlorate ion, chlorate ion and bromate ion consisting essentially of 0.01 to 0.2 wt. % zinc ion, 0.3 to 5 wt. % phosphate ion, wherein the phosphate and zinc ion sources are alkali metal free, and at least one compound selected from the group consisting of tartaric acid, citric acid and their water soluble salts in a weight ratio to zinc ion of from 0.1 to 20.

2. The composition of claim 1 exhibiting a pH of from about 3.5 to 4.7.

3. The composition of claim 2 additionally containing 0.01 – 0.2 wt.% nickel ion.

4. A process for forming a corrosion-resistant and paint receptive zinc phosphate coating on a ferrous surface comprising contacting the surface with the aqueous composition of claim 1 for a period of 0.5 to 5 minutes.

5. The process of claim 4 wherein the aqueous composition exhibits a pH of from about 3.5 to 4.7.

6. The process of claim 4 wherein the aqueous composition additionally contains 0.01 – 0.2 wt.% nickel ion.

7. The process of claim 4 wherein the aqueous solution is maintained at a temperature of about 50 to 60 degrees C.

* * * * *